US005637249A

United States Patent [19]

Smith

[11] Patent Number: 5,637,249

[45] Date of Patent: Jun. 10, 1997

[54] STECKEL MILL COILER FURNACE INCORPORATING HEATED PINCH ROLLS

[75] Inventor: Olan R. Smith, Regina, Canada

[73] Assignee: IPSCO Enterprises Inc., Wilmington, Del.

[21] Appl. No.: 270,174

[22] Filed: Jul. 1, 1994

[51] Int. Cl.[6] ..... H05B 6/14; B21C 47/06

[52] U.S. Cl. ..... 219/619; 219/614; 219/645; 219/655; 72/128; 72/148

[58] Field of Search ..... 219/602, 605, 219/618–619, 635–637, 645, 647, 652–655; 72/146, 148, 229, 231, 240, 250, 128; 242/535.1; 164/441

[56] References Cited

U.S. PATENT DOCUMENTS

| | | | |
|---|---|---|---|
| 4,430,874 | 2/1984 | Tippins et al. | 72/202 |
| 4,455,848 | 6/1984 | Tippins et al. | 72/12 |
| 4,522,050 | 6/1985 | Thomas | 72/229 |
| 4,703,640 | 11/1987 | Buchegger et al. | 72/128 |

*Primary Examiner*—Tu Hoang

*Attorney, Agent, or Firm*—Robert H. Barrigar; Barrigar & Moss

[57] ABSTRACT

For economy of operation, as much as possible of the total length of a steel strip being rolled by a Steckel mill should be maintained at an acceptably high temperature. To this end, the trailing edge of the strip is drawn into the coiler furnace to the extent possible without losing driving control of the strip. This is enabled by providing within or in close proximity with the entrance/exit port of the coiler furnace a pair of preferably heated pinch rolls that drive the trailing edge of the strip (that has just completed a pass through the Steckel mill) into the coiler furnace as far as possible, leaving only a very short protruding portion of that trailing edge outside the coiler furnace. The strip may be left idle within the coiler furnace for as long a time as is required to bring the temperature of the wound strip up to a target operating temperature. Then the same pair of pinch rolls in or near the entrance/exit port of the coiler furnace drive the strip out of the furnace toward the Steckel mill.

15 Claims, 1 Drawing Sheet

STECKEL MILL COILER FURNACE INCORPORATING HEATED PINCH ROLLS

FIELD OF THE INVENTION

This invention relates to Steckel mill design and particularly the use of pinch rolls, preferably heated pinch rolls, in close proximity to, and preferably within, the entry/exit port of each coiler furnace used in conjunction with a Steckel mill.

BACKGROUND TO THE INVENTION

Reversing rolling mills, herein referred to generically as "Steckel mills" operate in conjunction with a pair of coiler furnaces, one immediately upstream of the Steckel mill and one immediately downstream of the Steckel mill. Once the strip being rolled by the Steckel mill is of a thickness sufficiently small to be coiled within the coiler furnace, the leading edge of the strip is directed into the entrance/exit port or mouth of the collet furnace and wound up on the collet furnace drum. Conventionally, the trailing edge of the strip is stopped as close to the Steckel mill as possible so that rolling in the reverse direction can be commenced with as short a turnaround time as possible.

On the reverse reduction rolling of the strip, the strip is paid out of the coiler furnace from the drum via the entrance/exit port. On the initial payout, the strip is driven longitudinally by a pair of pinch rolls typically located between the coiler furnace and the Steckel mill in close proximity to the Steckel mill.

The purpose of the coiler furnace is, of course, to try to keep the temperature of the strip sufficiently high to enable the strip to be rolled successfully, and to obtain the desired metallurgical properties in the finished product. It is considered important under conventional practice to minimize the turnaround time between the reversal of direction of rolling so that the temperature drop in the strip being rolled is not unacceptable.

A problem with the conventional practice is that the leading and trailing edge portions of the strip enter the coiler furnace only on alternate passes and, therefore, are subject to more severe temperature drop than the intermediate portions of the strip which are within a coiler furnace for at least part of the time during each pass through the Steckel mill and into a coiler furnace. It is thus easier to maintain the intermediate portions of the strip at an acceptably high temperature than it is to maintain the leading and trailing ends of the strip at an acceptably high temperature. The problem is significant because the distance between the Steckel mill and the coiler furnace port may be as much 30 feet. The leading and trailing ends of the strip that enter the coiler furnaces only on alternate passes combined, therefore, may total as much as about 60 feet of the total length of the strip. This can be a significant portion—as much as ten percent or even somewhat higher—of the total length of the final coiled strip product. Depending upon customer requirements, the leading and trailing end pieces must frequently be severed from the coil before it is cut for shipment because of the failure of the leading and trailing ends to meet dimensional or metallurgical specifications. The leading and trailing end pieces cut off are essentially scrap steel that must be reprocessed entirely to be of any commerical value, and this adds appreciably to the cost per ton of the finished coil product being produced by the Steckel mill.

SUMMARY OF THE INVENTION

The problem to be addressed is the maintenance of an adequately high temperature of the strip being rolled in the Steckel mill. The conventional approach has been to attempt to minimize temperature drop in the strip by minimizing the total time spent rolling. This is accomplished under conventional practice by positioning the trailing edge of the strip (to become the leading edge on the next pass) as close to the Steckel mill as possible so that the next pass may be commenced as quickly as possible, thus reducing the total time spent in the rolling operation. The conventional practice has been adopted in the belief that minimizing the total time spent in the rolling operation is highly desirable, tending to minimize overall temperature drop and to maximize the opportunity to generate desirable metallurgical and dimensional criteria for at least the intermediate portions of the strip that enter the coiler furnaces on each pass.

I approach the solution of this problem from a fundamentally different perspective. My perspective is that, for economy of operation, as much as possible of the total length of the strip being rolled should be maintained at an acceptably high temperature. This, however, is only possible if the conventional practice of stopping the trailing edge of the strip (to become the leading edge on the next pass) as close to the Steckel mill as possible is abandoned and, instead, that trailing edge drawn into the coiler furnace to the extent possible without losing driving control of the strip.

Accordingly, I provide at, or in close proximity with, the entrance/exit port (frequently referred to in the industry as the "throat") of the coiler furnace, a pair of pinch rolls that drive the trailing edge of the strip (that has just completed a pass through the Steckel mill) into the coiler furnace as far as possible, leaving only a very short protruding portion of that trailing edge outside the coiler furnace. The strip may be left idle within the coiler furnace for as long a time as is required to bring the temperature of the wound strip up to a target operating temperature. Then the same pair of pinch rolls in or near the entrance/exit port of the coiler furnace drive the strip out of the furnace toward the Steckel mill where the conventional pinch rolls, and eventually the Steckel mill rolls themselves, grip the strip and drive it throughout the rolling pass.

Of course, both coiler furnaces are designed generally symmetrically so that optimally in accordance with the invention, each has a pair of pinch rolls in or close proximity to its entrance/exit port. This design and method of operation enable almost the entire length of the strip to enter the coiler furnace on each pass through the Steckel mill. Only a relatively short length—perhaps a foot or two—need protrude outside the coiler mill port, and thus the amount of waste product tends to be minimized.

Desirably, the pinch rolls are positioned within the coiler furnace, or within a hood immediately adjacent the coiler furnace, so that the length of strip drawn into the coiler furnace may be maximized. Accordingly, the pinch rolls are desirably heated rolls of the general type that are conventionally used as slab support rolls within tunnel furnaces. Such pinch rolls are typically water-cooled to keep temperature under control, but the fact that they are heated means that heat loss from the trailing end of the strip tends to be minimal, since there will be little heat loss from the strip to the pinch rolls with which they are in contact. The location of the pinch rolls within the coiler furnace port is considered to be superior to the location of pinch rolls immediately outside the port because pinch rolls outside the port would not normally be heated (thereby increasing the heat loss of the trail end of the strip) and, further, would not be as efficient as pinch rolls located within the furnace (i.e. within the entrance/exit port of the furnace) to pull as much as possible of the total length of the strip into the coiler furnace on each pass.

Because Steckel mills are frequently called upon to roll plate that is too thick to be coiled and, consequently, cannot be paid into the coiler furnace until after a few passes through the Steckel mill, a conventional pair of unheated pinch rolls located between each coiler furnace and the Steckel mill would continue to be necessary to drive the leading end of such slabs or strip into the Steckel mill roll bite at the beginning of each pass of such slabs while they are still flat and too thick to coil in the coiler furnace.

Furthermore, to minimize wear of the pinch rolls within the coiler furnace, and to optimize the payout of strip from the coiler furnace, it is desirable that the conventional pair of pinch rolls be located in close proximity to the coiler furnace at the end of the pivoting gate extension that is conventionally found immediately outside the entrance/exit port of the coiler furnace for the purpose of guiding strip into and out of the coiler furnace (which gate extension drops out of the way when slab is passed underneath the coiler furnace without being coiled). As soon as the leading end of the strip has been paid out by the heated pinch rolls within the coiler furnace to reach the unheated pinch rolls at the end of the gate, the unheated rolls can take up the job of driving the strip to the bite of the Steckel mill. Accordingly, the time during which the coiler furnace-heated pinch rolls operate to drive the strip can be quite small, and wear on such rolls can consequently be kept to a minimum.

In the operation of a Steckel mill provided with coiler furnaces thus equipped according to my invention, it is possible, as mentioned above, to retain the coiled strip within the coiler furnace for as long a period of time as may be justified according to the type of strip being rolled and the exigencies of the situation. It may be preferred, in at least some rolling operations, to retain the strip within the furnace for a time sufficient to bring the trailing end of the strip up to a desired temperature before paying out the strip from the coiler furnace to the Steckel mill for the next roll pass. The result may be that the total rolling time required to produce the product is somewhat longer than would be the case under conventional practice, but this loss of time may be more than offset by the increased useful length of the final coil strip, since a much longer intermediate portion than would be possible under conventional practice can be produced having the requisite metallurgical and dimensional properties.

THE DRAWING

The drawing FIG. 1 is a schematic elevation view, partly in section, of a Steckel mill and pair of associated coiler furnaces and other associated equipment designed and constructed in accordance with the principles of my invention.

DETAILED DESCRIPTION WITH REFERENCE TO THE DRAWING

Figure 1:
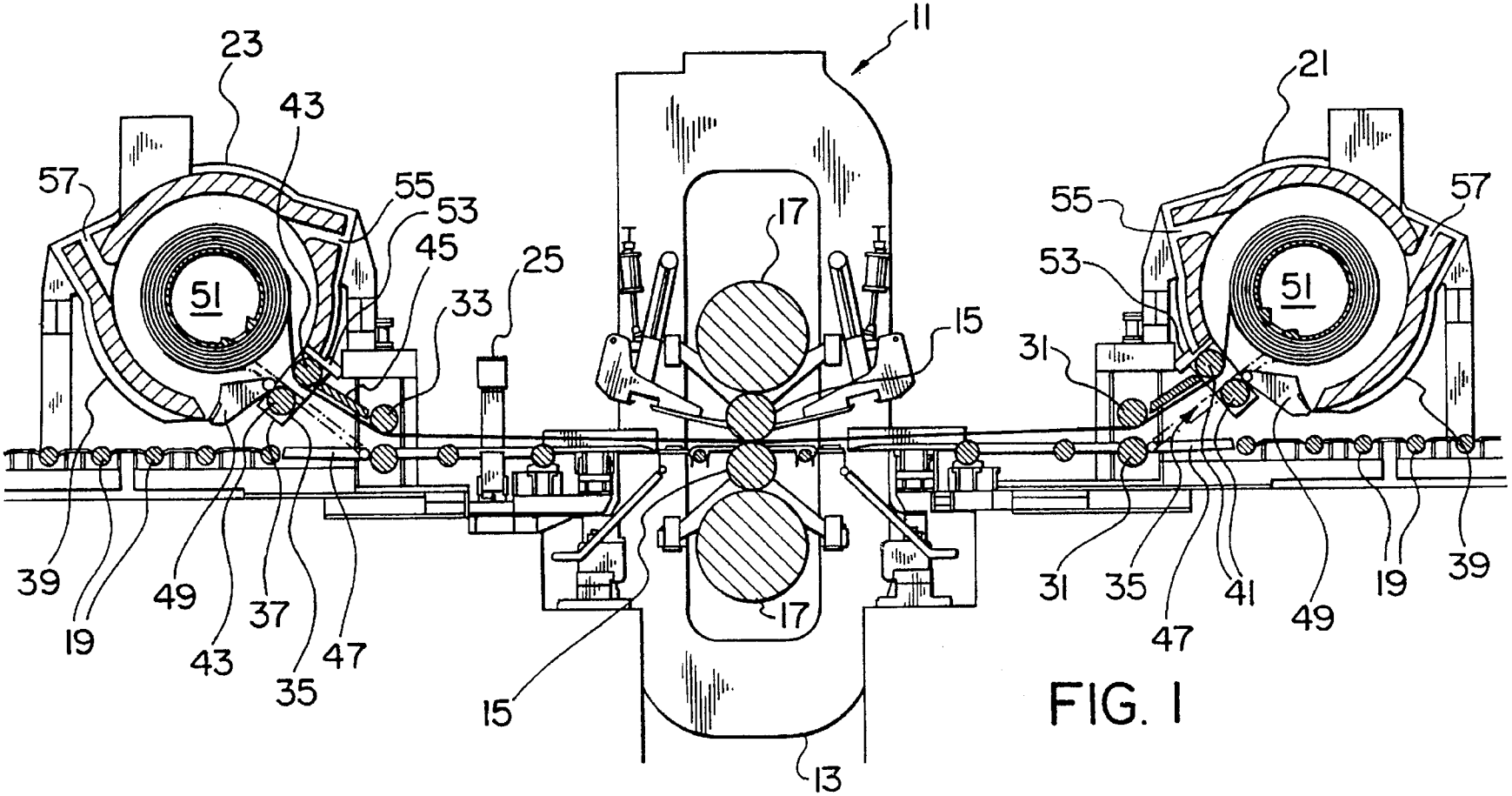

A Steckel mill generally indicated as 11 is provided with a frame 13 in which a pair of reducing work rolls 15 and associated back-up rolls 17 are rotatably mounted. Table rolls 19 positioned as required drivingly support the slab or strip of steel being rolled, both upstream and downstream of the Steckel mill.

An upstream coiler furnace 21 and a downstream coiler furnace 23 are located immediately upstream and immediately downstream respectively of the Steckel mill 11 within the limits imposed by the need to interpose some equipment between the Steckel mill 11 and each of the coiler furnaces 21 and 23. Illustrated by way of example are x-ray gauges 25, and unheated pinch rolls, the upstream pair of unheated pinch rolls being designated as 31 and the downstream pair designated as 33. [The term "unheated" is used in a relative sense; the rolls 31, 33 are much cooler than the heated rolls 41, 43.]

At the entrance/exit port generally indicated as 35 for each of the coiler furnaces 21, 23, is a hooded collar 37 forming a continuum with the wall 39 of each of the coiler furnaces 21, 23. The collar 37 is provided with an upper shield element 53 that inhibits heat escape from the entrance/exit port 35. Rotatably mounted within the hooded collar 37 of each of the coiler furnaces 21, 23 are a pair of pinch rolls, those for the upstream coiler furnace 21 being designated by reference numeral 41, and those for the downstream coiler furnace 23 being designated as 43. Located between the two pairs of pinch rolls 31, 41 and 33, 43 respectively are fixed upper shields 45 and pivoting lower gate extensions 47. The upper shields 45 and lower gate extensions 47 are arranged to span as much as possible of the distance between the roll pairs 31, 41 and 33, 43 respectively so as to minimize heat loss of the strip as it passes between the unheated pinch rolls 31, 33 respectively and the heated pinch rolls 41, 43 respectively.

The gate extension 47 must be able to pivot out of the way when a slab or strip too thick to be coiled in the coiler furnace is being rolled and must pass underneath the coiler furnace. Also, the downstream gate extension 47 must be able to pivot out of the way on the last pass so that the strip may be fed to any further downstream processors and eventually to a downcoiler for coiling the strip for shipment. In the drawing, the gate extension 47 is shown in its lowermost position in solid lines (permitting strip or slab to pass freely underneath the associated coiler furnace) and, in its elevated position, in broken lines. The broken line position is the position that the gate extension 47 would occupy when sheet is being paid into or out of the associated coiler furnace 21, 23, as the case may be.

Within each of the coiler furnaces 21, 23 is pivotally mounted a strip guide (frequently referred to in the industry as a gate) 49. The strip guide 49 occupies its lowermost solid-line position when strip is being paid off the drum by pinch rolls 41 or 43 in the direction of the Steckel mill 11. The guide 49 is in its upper broken-line position when strip is being paid into the coiler furnace; the guide 49 at such time facilitates the direction of the strip into engagement with the central coiling drum 51 within the respective coiler furnace 21 or 23, as the case may be.

The design of coiler furnaces has undergone an evolution in recent years, and the particular coiler furnace design illustrated is intended to be exemplary only, and not limiting. Further, the rolls 43 need not be placed within a hooded collar—they could be positioned in varying locations within or near the periphery of the coiler furnace. It is obvious that they should not encroach upon the space required within the coiler furnace to wind up the incoming strip. Equally, they should not be placed any further from the periphery of the coiler furnace than necessary, because the further away they are from the coiler furnace periphery, the greater the length of trailing end of strip that will not be able to enter the coiler furnace (some slight length of trailing end must normally be left outside the bite between pinch rolls 41 or 43, as the case may be, in order to provide a margin for error).

In operation, a strip of steel from the upstream side of the Steckel mill 11 enters the bite between reduction rolls 15, is reduced in thickness and, if sufficiently thin, is then directed via pinch rolls 33, gate extension 47, pinch rolls 43 and guide 49 into engagement with drum 51 within coiler furnace 23, whereupon the strip is wound up on the drum 51 until only a short trailing end portion protrudes outside of the bite between the pinch rolls 43. If the temperature of the trailing end within the coiler furnace is of a sufficiently high temperature, then the coiled strip within the coiler furnace 23 may be immediately paid out and directed to the Steckel mill via pinch rolls 43 and 33. If, however, the trailing end of the coiled strip within the coiler furnace 23 is not of a sufficiently high temperature, it may be retained within the coiler furnace 23 for a short time so that its temperature can be raised. It is then paid out by the pinch rolls 43 as before.

Note that preferably the pinch rolls 41, 43 are heated to approximately the coiler furnace temperature. In conventional coiler furnaces, the interior temperature is maintained at about 1000°. Accordingly, the pinch rolls are heated to a temperature of about 1,000° C. by the coiler furnace burners 55, 57. Note that the only path for the effluent hot gases from the coiler furnaces is directly past the heated pinch rolls 41, 43.

Once what is now the leading end of the strip is paid out by pinch rolls 43, the leading end shortly reaches the unheated pinch rolls 33. Then those rolls 33 take over the driving operation for the strip and impel it toward the bite between reduction rolls 15 in Steckel mill 11. When the strip reaches the bite between rolls 15, those rolls assume the longitudinal driving operation for the strip and both reduce the thickness of the strip and impel it upstream. The leading edge of the strip is guided via upstream unheated pinch rolls 31, gate extension 47, heated pinch rolls 41, and guide 49 into engagement with drum 51 within upstream coiler furnace 21. Once engagement with drum 51 occurs, the drum 51 winds up the strip and coils it within the furnace 21 until only a small trailing end is left protruding externally of the bite between heated pinch rolls 41. The entire operation is then repeated in mirror image.

The reference herein to "heated" pinch rolls 41 and 43 is not intended to imply that an auxiliary heat source special to these rolls is necessary. The rolls become heated by radiation, conduction and convection from the main sources of heat 55 and 57 (typically gas-jet burners) that supply heat to the furnaces 21 and 23.

Other variants in the design will readily occur to those skilled in the art without departing from the principles of the present invention. The scope of the present invention is as defined in the appended claims.

What is claimed is:

1. A coiler furnace for use in combination with a reversing rolling mill to provide a flat-pass path for passage of steel strip being rolled that bypasses said coiler furnace, said coiler furnace having:

(a) a winding drum for receiving and coiling a strip of steel from flat pass path, said winding drum having an axis of rotation and a winding space around said axis of rotation, said winding space encompassing said winding drum and said steel strip when coiled, (b) a peripheral wall for enclosing said winding space having an inner side and an outer side, (c) a heat source fixed to said peripheral wall for heating the interior of the coiler furnace;

(d) an entrance-exit port through which the strip of steel passes to and from the reversing rolling mill, and (e) a mating pair of heated pinch rolls, each of said heated pinch rolls (i) having a cylindrical surface of a length at least equal to the width of said steel strip being rolled, for guiding and drivingly engaging said strip of steel entering or leaving the coiler furnace, (ii) being rotatably and drivingly transversely mounted proximate to the entrance-exit port of the coiler furnace, offset from said flat-pass path and outside but proximate to said winding space, (iii) having an axis of rotation generally parallel to the axis of rotation of the winding drum of the coiler furnace, and, (iv) being heated by said heat source.

2. A coiler furnace as defined in claim 1, wherein the cylindrical surfaces of the heated pinch rolls are in generally peripheral alignment with the inner and outer sides of the peripheral wall of the coiler furnace.

3. A coiler furnace as defined in claim 2, wherein the heated pinch rolls are located within a hooded collar having an inner wall contiguous with said inner side of said coiler furnace peripheral wall.

4. In combination with a coiler furnace as defined in claim 2, a reversing rolling mill having work rolls, each of said work rolls being mounted for rotation about a generally horizontal transverse axis relative to the strip of steel to be rolled, said axes of rotation of said work rolls being generally parallel to the axes of rotation of said heated pinch rolls; wherein said coiler furnace is disposed relative to the reversing rolling mill so that the entrance-exit port of the coiler furnace is offset in a general direction of the reversing rolling mill from the axis of rotation of the winding drum of the coiler furnace.

5. The combination of claim 4, wherein said work rolls have a bite located therebetween and contact said steel strip; the combination additionally comprising a mating pair of unheated pinch rolls, said unheated pinch rolls:

(a) being mounted for generally horizontal transverse rotation relative to the strip of steel to be rolled, (b) being located between the heated pinch rolls and the reversing rolling mill, and (c) having a bite located where said unheated pinch rolls contact said steel strip;

wherein said bite of the unheated pinch rolls is in generally horizontal alignment with the bite between the work rolls of the reversing rolling mill.

6. The combination of claim 5, wherein the unheated pinch rolls are disposed in proximity to the heated pinch rolls and are separated therefrom by an upper fixed shield and a lower pivotable gate extension for guiding the steel strip as it travels between said heated and unheated two pairs of pinch rolls.

7. The combination of claim 6, wherein (a) the gate extension is controllably pivotable to a passive position to afford a clear path of travel along said flat-pass path for steel strip bypassing the coiler furnace, and is controllably pivotable to an active position to guide the steel strip into said coiler furnace, (b) the coiler furnace is spaced from the flat-pass path of the steel strip so as to permit the steel strip to bypass the coiler furnace without contact.

8. In combination, a coiler furnace and a reversing rolling mill providing a flat-pass path for passage of steel strip being rolled that bypasses said coiler furnace, said coiler furnace comprising:

(a) a winding drum for receiving and coiling a strip of steel, said winding drum having an axis of rotation and a winding space around said axis of rotation, said winding space encompassing said winding drum and said steel strip when coiled;

(b) a peripheral wall for enclosing said winding space having an inner side and an outer side;

(c) a heat source fixed to said peripheral wall for heating the interior of the coiler furnace to a working temperature;

(d) an entrance-exit port through which the strip of steel passes to and from the reversing rolling mill, and (e) a first mating pair of heated pinch rolls, each one of said first mating pair of heated pinch rolls (i) having a cylindrical surface of a length at least equal to the width of said steel strip being rolled, for guiding and drivingly engaging said steel strip entering or leaving the coiler furnace, (ii) being rotatably and drivingly transversely mounted proximate to said entrance-exit port, offset from said flat-pass path and outside but proximate to said winding space, and (iii) having an axis of rotation, said axes of rotation of said first mating pair of heated pinch rolls being generally parallel to said axis of rotation of said winding drum;

the combination additionally comprising a second mating pair of pinch rolls, each of said second mating pair of pinch rolls (a) being of a length at least equal to the width of steel strip being rolled;

(b) being rotatably and drivingly transversely mounted between said first mating pair of heated pinch rolls and the reversing rolling mill; and, (c) having an axis of rotation generally parallel to said axes of rotation of said first mating pair of heated pinch rolls.

9. A coiler furnace as defined in claim 8, wherein said first mating pair of heated pinch rolls are heated to a working temperature approximately equal to said coiler furnace working temperature.

10. A coiler furnace as defined in claim 8, wherein the cylindrical surfaces of the heated pinch rolls are in generally peripheral alignment with the inner and outer sides of the peripheral wall of the coiler furnace, and are heated by the heat source of the coiler furnace.

11. A coiler furnace as defined in claim 8, wherein the heated pinch rolls are located within a hooded collar having an inner wall contiguous with said inner side of said coiler furnace peripheral wall.

12. In combination with a coiler furnace as defined in claim 10, a reversing rolling mill having work rolls, each of said work rolls being mounted for rotation about a generally horizontal transverse axis, said axes of rotation of said work rolls being generally parallel to said axes of rotation of said heated pinch rolls; wherein said coiler furnace is disposed relative to the reversing rolling mill so that the entrance-exit port of the coiler furnace is offset from the axis of rotation of the coiler furnace in the general direction of the reversing rolling mill.

13. The combination of claim 12, wherein (a) said work rolls have a bite located where said work rolls contact said steel strip, and (b) said mating pair of unheated pinch rolls have a bite located where said unheated pinch rolls contact said steel strip;

wherein said bite of said unheated pinch rolls is in generally horizontal alignment with said bite of said work rolls.

14. The combination of claim 13, wherein said unheated pinch rolls are proximate to the heated pinch rolls and are separated therefrom by an upper fixed shield and a lower pivotable gate extension for guiding the steel strip as it travels between two pairs of said heated and unheated pinch rolls.

15. The combination of claim 14, wherein (a) said gate extension is controllably pivotable to a passive position to afford a clear path of travel along said flat-pass path for steel strip bypassing the coiler furnace, (b) said gate extension is controllably pivotable to an active position to guide the steel strip into said coiler furnace, (c) said coiler furnace is spaced from said flat-pass path so as to permit the steel strip to bypass the coiler furnace without contact.

* * * * *